US009285775B2

(12) United States Patent
Graemiger et al.

(10) Patent No.: US 9,285,775 B2
(45) Date of Patent: Mar. 15, 2016

(54) TIMEPIECE MECHANISM FOR CORRECTING A DISPLAY DEVICE FOR DISPLAYING TIME INFORMATION, AND TIMEPIECE MOVEMENT AND TIMEPIECE COMPRISING THE TIMEPIECE MECHANISM

(71) Applicant: ROLEX SA, Geneva (CH)

(72) Inventors: Pierre-Alain Graemiger, Trélex (CH); Marco La China, Aïre (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/328,215

(22) Filed: Jul. 10, 2014

(65) Prior Publication Data

US 2015/0016230 A1 Jan. 15, 2015

(30) Foreign Application Priority Data

Jul. 12, 2013 (EP) ..... 13176378

(51) Int. Cl.

| | |
|---|---|
| ***G04B 27/02*** | (2006.01) |
| ***G04B 19/02*** | (2006.01) |
| ***G04B 19/08*** | (2006.01) |
| *G04F 7/08* | (2006.01) |

(52) U.S. Cl.

CPC ..... *G04B 27/02* (2013.01); *G04B 19/02* (2013.01); *G04B 19/025* (2013.01); *G04B 19/082* (2013.01); *G04B 19/087* (2013.01); *G04F 7/0866* (2013.01); *G04F 7/0871* (2013.01)

(58) Field of Classification Search

CPC ..... G04B 19/02; G04B 19/08; G04B 27/02; G04B 27/023; G04B 27/026; G04B 19/025; G04B 19/087; G04B 19/082; G04F 7/08; G04F 7/0871; G04F 7/0866

See application file for complete search history.

(56) References Cited

U.S. PATENT DOCUMENTS

| | | | |
|---|---|---|---|
| 256,418 | A | 4/1882 | Wensch |
| 2,909,892 | A | 10/1959 | Lucian et al. |
| 5,956,294 | A | 9/1999 | Takizawa et al. |
| 7,293,911 | B2 | 11/2007 | Bonvin et al. |
| 7,625,116 | B2 | 12/2009 | Bron et al. |

(Continued)

FOREIGN PATENT DOCUMENTS

| | | | |
|---|---|---|---|
| CH | 700 902 | A2 | 10/2010 |
| CH | 703 470 | A2 | 1/2012 |

(Continued)

OTHER PUBLICATIONS

European Search Report dated Jan. 31, 2014, issued in corresponding application No. EP 13 17 6378 (w/English partial translation and partial machine-translation).

(Continued)

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

A mechanism for correcting a device for displaying time information is described. The display device includes a first display member for displaying current time information and a second display member for displaying stored time information, notably a second display member of the retrograde type. The mechanism includes an isolating device for isolating the first and second display members.

22 Claims, 14 Drawing Sheets

(56) References Cited

U.S. PATENT DOCUMENTS

| | | | | |
|---|---|---|---|---|
| 8,398,299 | B2 | 3/2013 | Wiederrecht | |
| 8,545,092 | B2 | 10/2013 | Habring et al. | |
| 2001/0046187 | A1* | 11/2001 | Graemiger | 368/190 |
| 2006/0233054 | A1* | 10/2006 | Ryter | 368/190 |
| 2007/0091727 | A1 | 4/2007 | Bonvin et al. | |
| 2008/0106979 | A1 | 5/2008 | Bron et al. | |
| 2008/0144448 | A1* | 6/2008 | Goeller | 368/190 |
| 2008/0159082 | A1* | 7/2008 | Hiraga et al. | 368/228 |
| 2008/0253235 | A1* | 10/2008 | Hiraga et al. | 368/172 |
| 2010/0246341 | A1* | 9/2010 | Papi et al. | 368/172 |
| 2010/0322038 | A1 | 12/2010 | Habring et al. | |
| 2011/0205854 | A1 | 8/2011 | Wiederrecht | |
| 2013/0003507 | A1* | 1/2013 | Billet et al. | 368/106 |
| 2013/0128706 | A1 | 5/2013 | Graf et al. | |
| 2014/0022870 | A1 | 1/2014 | Tran et al. | |

FOREIGN PATENT DOCUMENTS

| | | | |
|---|---|---|---|
| CH | 704696 | A2 | 9/2012 |
| EP | 0 851 321 | A2 | 7/1998 |
| EP | 1 475 681 | A1 | 11/2004 |
| EP | 1475681 | A1 | 11/2004 |
| EP | 1777598 | A1 | 4/2007 |
| EP | 1 918 792 | A1 | 5/2008 |
| EP | 2 159 652 | A1 | 3/2010 |
| EP | 2159652 | A1 | 3/2010 |
| WO | 2009/098307 | A1 | 8/2009 |

OTHER PUBLICATIONS

European Search Report dated Jan. 31, 2014, issued in European application No. EP13176381, counterpart of co-pending U.S. Appl. No. 14/328,282 (w/ partial English translation and partial English machine-translation) (10 pages).

Office Action dated Mar. 26, 2015, issued in co-pending U.S. Appl. No. 14/328,282 (11 pages).

Notice of Allowance dated Sep. 16, 2015, issued in co-pending U.S. Appl. No. 14/328,282 (14 pages).

* cited by examiner

TIMEPIECE MECHANISM FOR CORRECTING A DISPLAY DEVICE FOR DISPLAYING TIME INFORMATION, AND TIMEPIECE MOVEMENT AND TIMEPIECE COMPRISING THE TIMEPIECE MECHANISM

The invention concerns a timepiece mechanism for indicating and storing time information and a mechanism for correcting a device for displaying time information. The invention also concerns a timepiece movement including such a mechanism. The invention further concerns a timepiece, notably a watch, including such a movement or such a mechanism.

The document EP1475681 describes a device in a chronograph enabling the display of fractions of a second only when the chronograph is stopped. This system uses a cam fastened to a gear turning at the rate of one revolution per second. The time information is displayed by means of a rack that interengages with the display member and that is able to be in contact with the cam. When the chronograph is stopped, the follower of the rack is in contact with the flank of the cam and is therefore positioned so as to display the time information. On starting or resetting the chronograph, the follower of the rack is raised into a predetermined position by an arm or by a column wheel so that it is removed from the path of the cam.

The document CH700902 concerns a switching mechanism capable of indicating time information on demand. This system has the particular feature of displaying day/night information only when adjusting the timepiece. This employs the characteristic elements of the conventional retrograde display device. In normal operation, when the crown is pushed in, the end of the stem controls the angular position of the follower so that its tip is not in contact with the flank of a cam effecting one complete revolution in 24 hours. In the time-setting position, the stem releases the follower which is pressed against the cam by a return spring.

The document EP2159652 concerns a time display mechanism for selectively displaying the current time. When actuated by a drive lever, the set of hands indicates the time in the conventional way or is disposed in a predetermined position. This device employs snail-shaped cams that are respectively interengaged with the hours kinematic system and the minutes kinematic system. The time information is displayed by means of racks respectively interengaged with the hours hand and the minutes hand. In the position in which the time is not displayed the racks, actuated by the drive lever, are positioned so that their followers are outside the travel of the cams. Consequently, the set of hands is disposed in a predetermined position.

The application EP1918792A1 concerns a clutch device added to the conventional retrograde display device which, in the phase of adjusting the timepiece, uses a return lever to move the follower of the retrograde display lever out of the path of the snail-shaped cam. This return lever bears a toothed portion adapted to act directly on the gear that carries the retrograde time information, when actuated by a drive cam itself driven by the stem. This solution therefore requires a significant number of components that are added to the retrograde mechanism. Moreover, during any phase of storing retrograde information, immobilization of the retrograde display lever causes immobilization of the return lever. In this configuration it is therefore not possible to act on the return lever. It is therefore not possible to act on the device for adjusting the timepiece because of the risk of breakage.

The application EP0851321A2 concerns a multifunction watch that is notably provided with a mechanism for rapid correction of the time. The latter is kinematically coupled to a device for retrograde display of the day of the week indication. When the stem actuating this correction device is pulled out, the follower of the retrograde lever is raised by the effect of the movement in translation of a return lever that is moved in translation by the rotation of the pull-out piece. Accordingly, if the stem is manipulated in the fast time correction position, the follower of the retrograde lever is removed from the path of the snail-shape cam and the day indication retrograde hand is disposed in a predetermined position. Moreover, it is apparent that, during any phase of storing retrograde information, immobilization of the retrograde display lever immobilizes the return lever in translation. The stem can therefore not be pulled out and the correction position reached in this configuration.

In the light of the prior art, it seems that there does not exist any switching mechanism capable of using the same display member to indicate selectively current information or stored information. It is in fact found that the known switching mechanisms enable only selective indication of current information or predetermined information that it is not possible to adjust. To this end, a device associated with the display device is used to drive a lever of the display device mounted on the frame of a timepiece in a predetermined position.

In the light of the prior art, it seems that there does not exist either any correction mechanism for a retrograde device that can be actuated at any time.

The object of the invention is to provide a timepiece mechanism for indicating and storing time information and a mechanism for correcting a device for displaying time information. In particular, the invention proposes a timepiece mechanism for indicating and storing time information enabling selective indication by the same display member of current information and stored information and a mechanism for correcting a device for displaying time information that enables correction of a timepiece, notably of a timepiece indicating stored time information, at any time.

A mechanism in accordance with the first aspect of the invention is defined as follows. The mechanism is intended for indicating and storing time information. The mechanism includes a transmission device coupling a time information counting system and a member for displaying time information adapted to display selectively current time information and stored time information, The mechanism, in particular the transmission device, includes:

a cam;

a lever device including a lever, a follower and a first elastic member urging the lever and the follower into a particular relative position;

the lever being kinematically coupled to the display member for displaying time information, the follower being urged against the cam by a second elastic member.

The lever device may be pivoted on a frame of the mechanism.

The mechanism may include an immobilizer of the lever actuated by a drive member, notably a push-piece, to position the immobilizer selectively in a first position releasing the lever or in a second position immobilizing or locking the lever.

The drive member may actuate the immobilizer via a storage drive member, such as a cam, notably a column wheel.

The immobilizer may act on an end of the lever and/or acts on the lever by friction.

The mechanism may include an isolating device having a first position in which the follower is kinematically coupled to the time information counting system and a second position in which the follower is uncoupled from the time information counting system.

The mechanism may include an isolating device having a first position in which the follower bears against the cam and a second position in which the follower is uncoupled from or at a distance from the cam.

The isolating device may be adapted to act on an end of the follower, notably to act through contact.

The isolating device may be in a first position when the immobilizer is in a first position and in a second position when the immobilizer is in a second position.

The isolating device may be coupled to a drive member, notably a pushbutton, itself coupled to the immobilizer.

The drive member may include a member for actuating the isolating device via a storage drive member, notably the column wheel that actuates the immobilizer.

The movement of the display member may be a retrograde movement.

The mechanism may include a retrograde or non-retrograde display member.

In accordance with the first aspect of the invention, a timepiece movement may include a mechanism as previously defined, in particular a timepiece movement including a mechanism as previously defined and in which the lever device is pivoted on a frame of the movement.

In accordance with the first aspect of the invention, a timepiece, notably a watch, in particular a wristwatch, includes a movement as previously defined or a mechanism as previously defined.

In accordance with a second aspect of the invention, a mechanism for correcting a device for displaying time information includes a first display member for displaying first time information and a second display member for displaying first stored information, notably a second display member of the retrograde type. The mechanism includes a device for isolating the first and second display members.

The isolating device may have a first configuration in which the positions of the first and second display members are linked and a second configuration in which the positions of the first and second display members are independent.

The isolating device may be actuated by a correction member, notably a pull-out piece, for selectively positioning the isolating device in the first configuration of the isolating device and in the second configuration of the isolating device.

The isolating device and the correction member may be such that actuation of the isolating device by the correction member causes the second display member to be positioned in a predefined position, notably in an extreme or abutment position.

A drive member and the isolating device may be such that the drive member actuates the isolating device, notably via a storage drive member, for example a column wheel.

The isolating device may be in the first configuration unless the drive member or the correction member is in a state conditioning the second configuration of the isolating device.

In the first configuration of the isolating device the follower may be pressed against a cam coupled to the display member by a second elastic member and in the second configuration of the isolating device the follower may be uncoupled from the cam, i.e. maintained at a distance from the cam.

The isolating device may be actuated by a correction member, notably a pull-out piece, to position the follower selectively in a first position defined by the first configuration of the isolating device and in a second position defined by the second configuration of the isolating device.

Actuation of the isolating device by the correction member may cause rotation of the lever.

The mechanism may include an immobilizer of the lever cooperating with a storage drive member, notably a column wheel, to position the immobilizer selectively in a first position releasing the lever or in a second position immobilizing the lever.

The isolating device, the correction member and the follower may be such that the follower is positioned in the second position by the correction member when an immobilizer is in a first position releasing the lever and/or the isolating device and the correction member and the follower may be such that the follower is positioned in the second position by the isolating device when an immobilizer is in a second position immobilizing the lever.

The isolating device may be adapted to act on one end of the follower and/or to constitute an obstacle acting on the follower.

In accordance with the second aspect of the invention, the timepiece movement includes a mechanism as defined above.

In accordance with the second aspect of the invention, the timepiece, notably the watch, in particular the wristwatch, includes a movement as defined above or a mechanism as defined above.

Unless there is some technical or logical incompatibility, any feature or any combination of features of the first aspect of the invention may be combined with any feature or any combination of features of the first aspect of the invention.

The appended drawings represent by way of example embodiments of timepiece mechanisms in accordance with the invention.

A first embodiment of a timepiece 1 in accordance with the first aspect of the invention is described hereinafter with reference to FIGS. 1 to 13. The timepiece is a watch for example, in particular a wristwatch. It includes a movement 2. This movement itself includes a mechanism 3 for indicating and storing time information one embodiment of which is described hereinafter.

As will be described hereinafter, the timepiece, notably the movement and more particularly the mechanism, has the specific feature of selectively indicating by means of the same display member current time information and stored time information, in particular stored values of the current time information. Selection is driven by the actuation of a single drive member 4. For example, such an indication and storage mechanism 3 may be useful for marking a time, time information or any information derived from time, on demand, by means of a conventional display member normally provided to display the current information in question.

Figure 1:
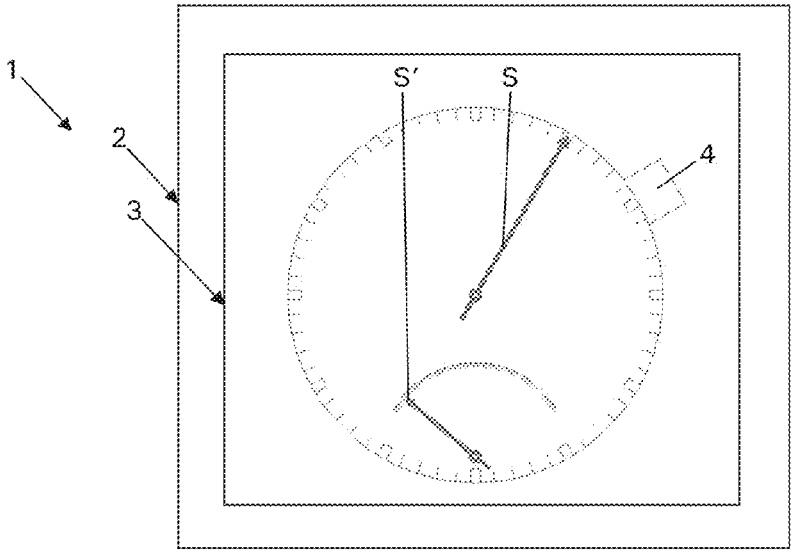
FIGS. 1 to 3 are diagrammatic views of one embodiment of a timepiece in accordance with a first aspect of the invention.

In the embodiment described, the stored information is represented or indicated by a retrograde system. Thus FIG. 1 shows an embodiment in which a seconds storage retrograde hand S' is added to the conventional seconds hand S of the timepiece. The movement of the display member S' consisting here of a storage hand may therefore be a retrograde movement.

Figure 2:
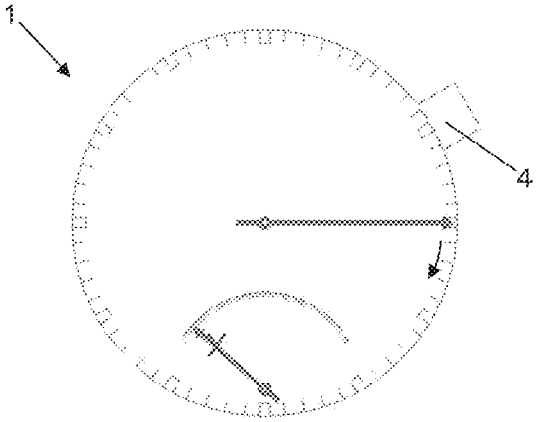
Figure 3:
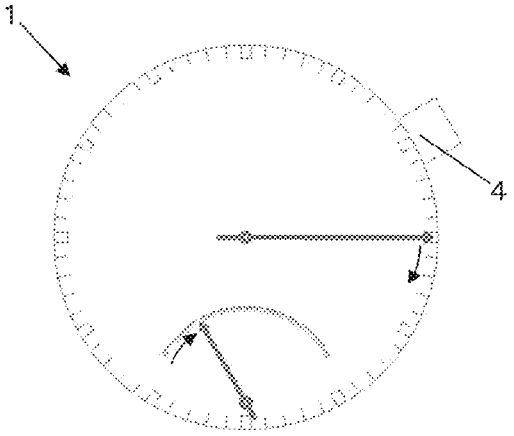

In normal operation, as represented in FIG. 1, the hand S', just like the seconds hand S, indicates the current second. A first action, notably pressing on the drive member 4 as represented in FIG. 2, causes the hand S' to be stopped without acting on the seconds hand S, which continues to move. There is then obtained on the timepiece in this state simultaneous indication or display of current time information and stored time information. A second action, notably pressing on the same drive member, repositions the hand S' so that it again displays the current second, as shown in FIG. 3. The two hands S and S' are therefore synchronized again. Each hand therefore displays the current second.

The mechanism 3 for indicating and storing time information includes a transmission device 7 coupling a counting system 5 able to supply the time information and a member S' for displaying the time information adapted to display selectively current time information and stored time information. The transmission device includes:

a cam C;

a lever device L including a lever L1, a follower L2 and a first elastic member R urging the lever and the follower into a particular relative position.

The lever L1 is kinematically coupled to the display member S' for displaying time information and the follower L2 is urged against the cam C by a second elastic member RL.

In this embodiment, the time information concerns seconds. It may equally well concern hours, minutes, even another time magnitude unit.

The display member may include or consist in a hand cooperating with markings bearing indications and/or graduations. By counting system is meant any device for driving at least the display member. The display member is preferably not part of the counting system. For example, a counting system includes an accumulator such as a barrel, a gear train, notably regulated by a balance/hairspring/escapement system.

By "selectively displaying current time information and stored time information" is meant that at any time, with the exception of transient phases, the display member indicates either current time information or stored time information. The transient phases are instantaneous or quasi-instantaneous. They last only a few fractions of a second, for example less than 0.3 second. The display member therefore never reaches a predefined position independent of the time. It follows that the display member exercises a time information display function continuously.

The lever device L is preferably pivoted on a frame 6 of the mechanism, notably a frame of the movement or the timepiece.

Figure 4:
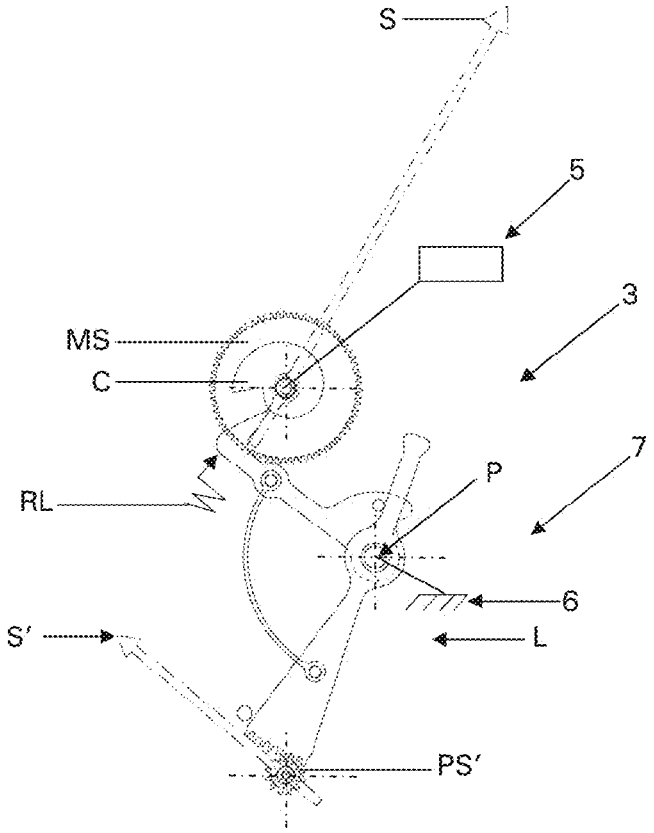
FIGS. 4 and 5 are diagrammatic views of one embodiment of a mechanism in accordance with the first aspect of the invention.

As represented in FIG. 4, the cam C is a snail-shaped cam, for example. It may be carried directly by a seconds mobile MS kinematically coupled to a second display member S for displaying time information. The second display member S may notably be disposed on the seconds mobile. The shape of the cam C is such that the first display member S' effects a retrograde travel with instantaneous return, for example. The second display member S may be retrograde or not.

The lever device L is pivoted about a pivot P. As already stated, the lever device has two parts: the lever L1 and the follower L2. Each of these parts pivots about the pivot P. The two parts are coupled to each other by a first elastic member such as a return spring R. This first return member is used to urge the lever and the follower into a particular relative position as shown in FIG. 4.

The lever L1 carries teeth L10 or a rack, for example at one of its ends. These teeth mesh with a gear PS' to which the display member S' is kinematically coupled. A seconds storage hand S' may notably be disposed on the gear PS'. The second part of the lever device includes a follower L2 including a follower head L20 that is pressed against the profile of the cam C by a second return elastic member RL.

Figure 5:
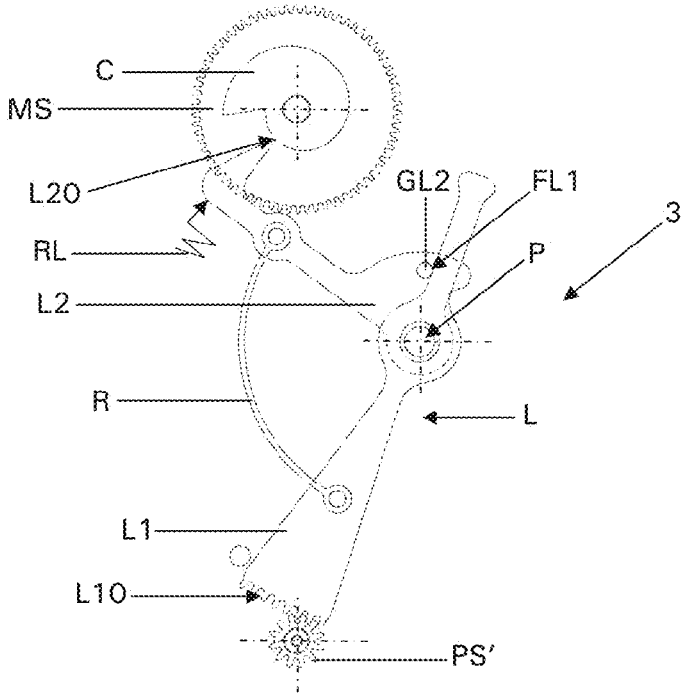
Figure 6:
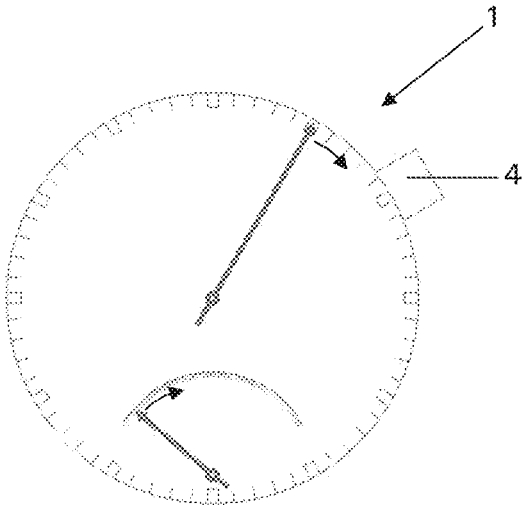
FIGS. 6 and 7 are diagrammatic views of the embodiment of the timepiece in accordance with the first aspect of the invention, these views illustrating the functioning of the timepiece.
Figure 7:
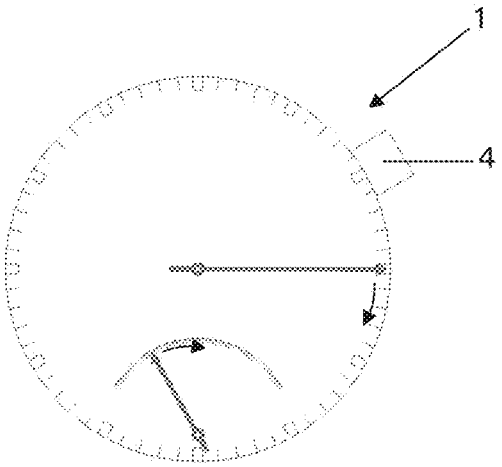

In normal operation, namely when the display members S and S' are synchronized, the lever device behaves as a rigid member. It may therefore be likened to a rigid component pivoting about the pivot P. In fact, the first elastic member R contributes to holding the lever and the follower in a predetermined position relative to each other. This predetermined position is defined by stops on the lever and the follower and cooperating with each other obstacle fashion in the predetermined position. For example, a pin GL2 is disposed on the follower L2 and adapted to abut against a flank FL1 of the lever L1, as represented in FIGS. 4 and 5. Alternatively, the pin could be disposed on the lever L1 and cooperate with a flank of the lever L2 or some other element of the follower.

Rotation of the cam C in the clockwise direction therefore causes rotation of the lever device L in the counterclockwise direction so that the teeth L10 can drive the display member S' synchronously with the second display member, as represented in FIGS. 6 to 9. Here "synchronization" means that the two display members indicate the same time value. However, their movements need not be identical. In particular, their angular movement speed values may be different.

The mechanism 3 advantageously includes an immobilizer LB for immobilizing the lever L1. The immobilizer may be actuated by the drive member O, notably the push-piece 4, to position the immobilizer selectively in a first position releasing the lever L1 or in a second position immobilizing or locking the lever L1.

To this end, the drive member O may actuate the immobilizer LB via a storage drive member RC, such as a cam, notably a column wheel.

The immobilizer may act on one end L100 of the lever L1 and/or act on the lever L1 by friction.

Figure 10:
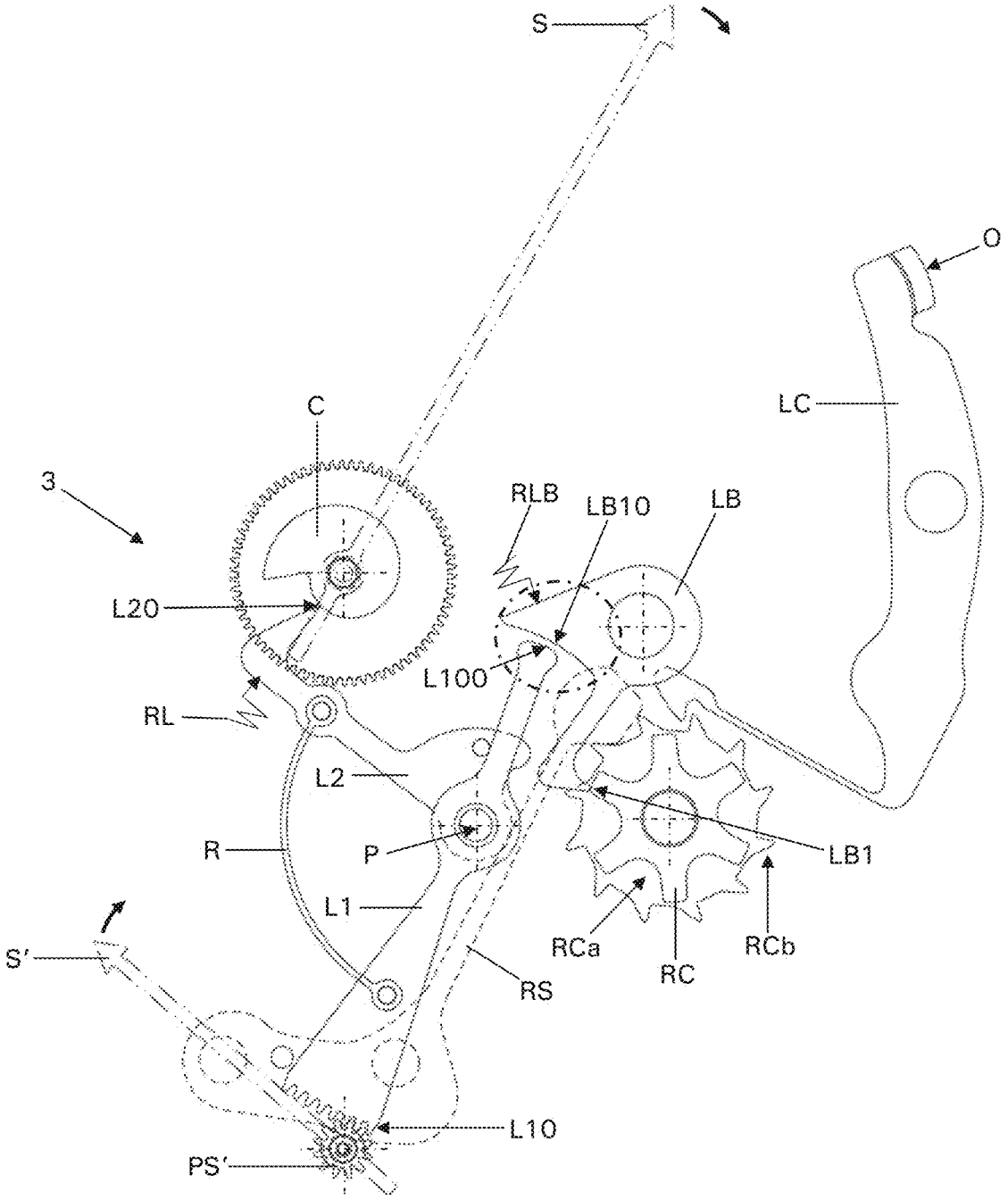

When the display members S and S' are synchronized, the immobilizing lever or immobilizer LB is positioned so that it cannot act on the lever L1, as represented in FIG. 10.

This immobilizer LB is driven by a storage drive member, for example, such as a cam that takes the form of a column wheel RC, for example, which is indexed angularly by a jumper spring RS. The latter may have a binary profile RCa that is constituted of columns and recesses. In the aforementioned configuration represented in FIG. 10, one end LB1 of the immobilizer LB bears against one of the columns of the cam RC so that an arm LB10 of the immobilizer LB is out of reach of the end L100 of the lever L1.

The column wheel RC also has ratchet teeth RCb adapted to be actuated and driven through one angular step via a drive lever LC by the drive member O, notably the push-piece 4. Pressing the latter causes rotation of the column wheel RC so that the end LB1 of the immobilizer LB is moved in a recess of the column wheel by a return spring RLB. In this configuration, represented in FIG. 11, the arm LB10 of the immobilizer LB exerts a force F against the end L100 oriented, notably as a function of the coefficient of friction f at the interface of the arm LB10 and the end of the lever L1, so that the lever L1 is immobilized or locked against rotation about the pivot P. However, for its part the follower L2 can turn about the pivot P by virtue of the rotation of the cam C. This rotation occurs against the first elastic member R, which is deformed. This situation results in immobilization of the display member S' while the second display member S continues its movement.

Figure 8:
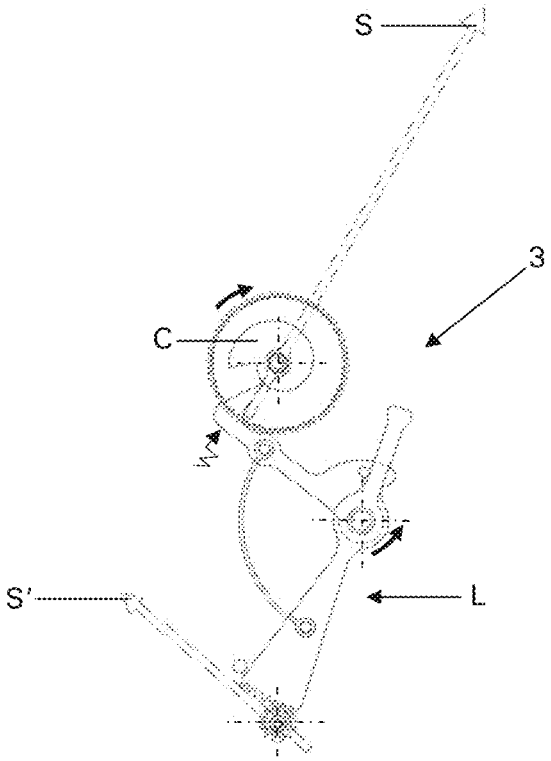
FIGS. 8 to 13 are diagrammatic detail views of the embodiment of the mechanism in accordance with the first aspect of the invention.
Figure 9:
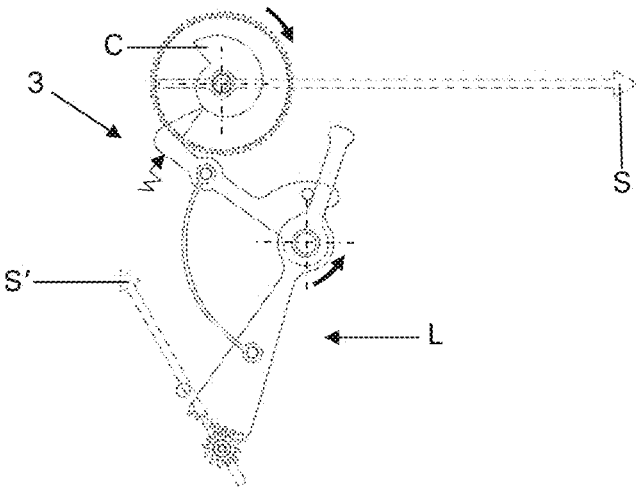

Pressing the drive member O again repositions the column wheel RC in a configuration analogous to that in FIG. 10. The arm LB10 of the immobilizer LB then moves away from the end L100 of the lever L1 against the action of the spring RLB. The lever L1 is therefore released, and by virtue of the effect of the first elastic member R, is then repositioned so that its flank FL1 comes to abut against the pin GL2 of the follower L2. The lever device L therefore resumes its configuration as shown in FIGS. 8 to 10. The display members S and S' are therefore synchronized again.

Figure 11:
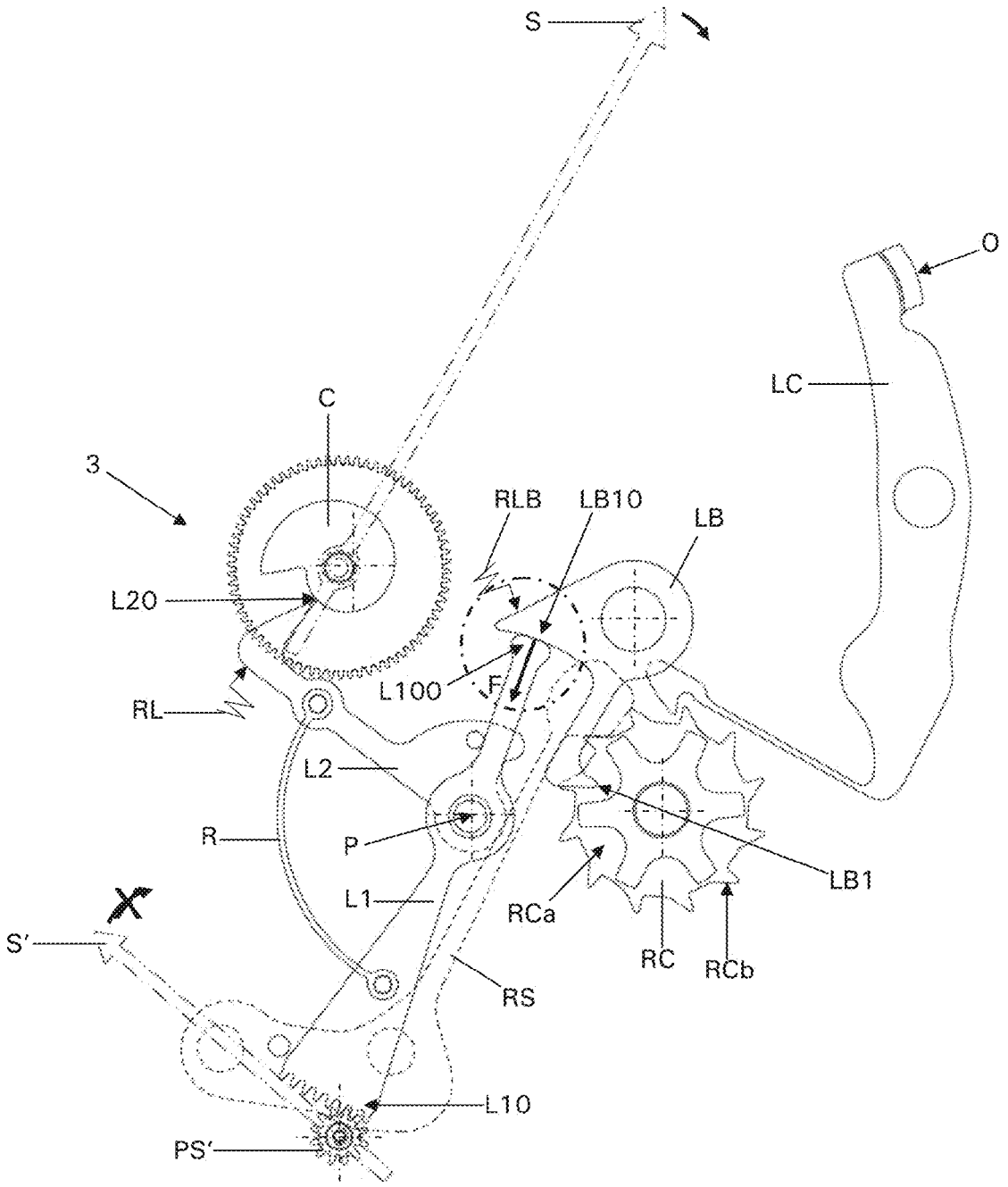

In the storage phase, i.e. when the display member S' indicates the stored time information, as represented in FIG. 11, the member driving movement of the timepiece, via the cam C, opposes the torque produced by the first elastic member R, which torque is added to that produced by the second elastic member RL. This situation is not the optimum with regard to the chronometry of the timepiece.

To solve this problem, the mechanisms 3 may include an isolating device L1 having a first position in which the follower L2 is coupled kinematically to the time information counting system and a second position in which the follower L2 is uncoupled from the time information counting system. Thus in the first position the follower L2 bears against the cam C and in a second position the follower L2 is uncoupled from the cam C or held at a distance from the cam C.

The isolating device is advantageously adapted to act on an end L200 of the follower L2, notably through contact therewith.

The isolating device and the immobilizer are preferably kinematically coupled, or even fastened or fixed to each other. Thus the isolating device may be in a first position when the immobilizer is in its first position and the isolating device is in a second position when the immobilizer is in its second position.

Figure 12:
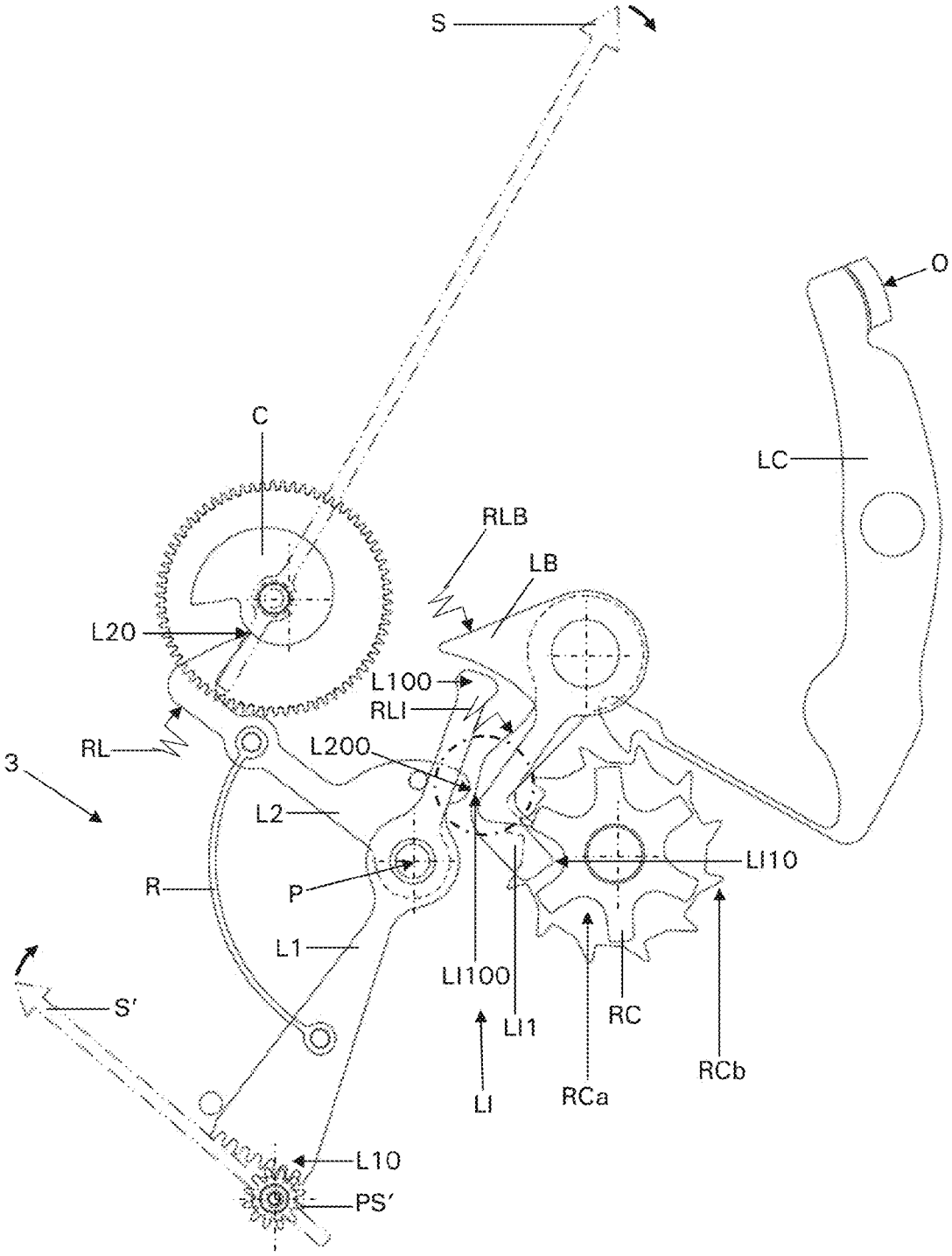
Figure 13:
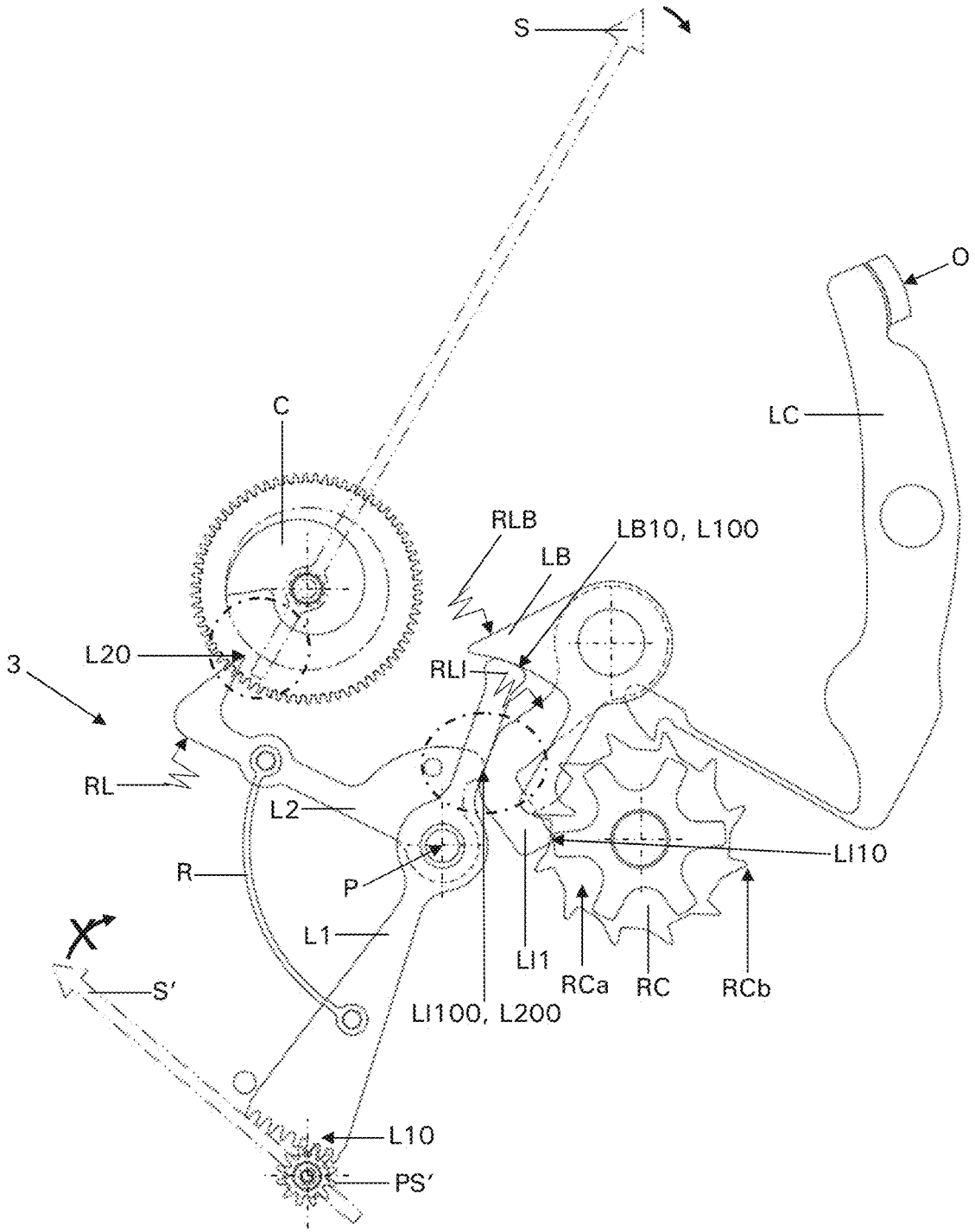

An isolating device LI is therefore preferably added to the immobilizer LB so as to remove the follower L2 from the path of the cam C when the immobilizer LB is immobilizing the lever L1. To this end, the isolating device LI operates synchronously with the immobilizer LB by way of the column wheel RC. FIGS. 12 and 13 show one such isolating device.

When the display members S and S' are synchronized as represented in FIG. 12, the isolating device LI, including an isolating lever LI1 and an elastic member RLI such as a spring, is positioned so that it cannot act on the follower of the lever device L, just like the immobilizer LB. To be more specific, an end LI10 of the isolating device LI is located in a recess of the profile RCa of the cam RC by virtue of the effect of a spring RLI so that a flank LI100 of the isolating device LI is out of reach of the flank L200 of the follower L2.

In the storage phase, as represented in FIG. 13, the flank LI100 of the isolating device LI bears against the flank L200 of the follower L2 against the springs R and RL, while the end L100 of the lever L1 is immobilized beforehand by the arm LB10 of the immobilizer LB. Accordingly, in all situations, notably those represented in FIGS. 12 and 13, the member driving the movement of the timepiece, via the cam C, offers the maximum opposition to the torque produced by the spring RL. This maximum opposition is encountered in the situation of synchronization of the display members.

Of course, a plurality of storage devices may be associated so as to store more than one item of time information, notably items that are kinematically linked, for example minutes and seconds indications, hours and minutes indications, or hours, minutes and seconds indications. These devices could advantageously be driven by a single drive member via a single cam RC intended to drive synchronously the levers of each of these items of time information. A mechanism, a movement or a timepiece can therefore be produced enabling storage of:

hours and minutes, or
minutes and seconds, or
hours, minutes and seconds.

The isolating device is advantageously coupled to the drive member O, notably to a pushbutton 4, the drive member being itself coupled to the immobilizer LB. The drive member therefore enables the position of the immobilizer and the isolating device to be changed simultaneously.

Also, the drive member may comprise a member for actuating the isolating device via a storage drive member RC, notably the column wheel, which actuates the immobilizer LB.

A second embodiment of a timepiece 1' in accordance with the second aspect of the invention is described hereinafter with reference to FIGS. 14 to 22. The timepiece is a watch, for example, in particular a wristwatch. It includes a movement 2'. This movement itself includes a mechanism 3' for correcting a device for displaying time information as described above.

The correction mechanism enables bidirectional correction for a device for displaying time information or time-derived information or bidirectional correction of a device for displaying time information or time-derived information. Such a mechanism is notably adapted to correct in both correction directions a time or time-derived indication that can be stored by a display and storage device conforming to the first aspect of the invention.

In the embodiment described, the information to be corrected is indicated in a retrograde manner, notably in a retrograde manner with instantaneous return. By "retrograde display" is meant any display able to employ a display member capable of pivoting in two rotation directions. Instead of effecting a complete revolution, the display member follows a path from a point of departure A to a point of arrival B in front of graduations representing a time-related magnitude, for example. Once the path from A to B has been completed, the indicator member may notably return backwards to the point A instantaneously. Hereinafter, the display members M and M' are minutes display members. However, they could equally well be hours or seconds display members, or even members displaying some other magnitude. As in the previous embodiment, the display members may comprise or consist of hands.

Elements of the embodiment in accordance with the second aspect of the invention and elements of the embodiment in accordance with the first aspect of the invention that are identical or have the same function bear the same references.

As in the first embodiment, a snail-shaped cam is used to display the information and to guarantee instantaneous return of the display member M' to a predetermined position by means of the lever device L and the return spring RL. This cam is kinematically coupled to the current time display system, and so is driven in rotation during forward and reverse correction of this current display. Now, the geometry of this cam, characterized by the presence of an steep flank to enable instantaneous return of the lever device and therefore the display member M', causes a problem during reverse correction. In fact, correction in the counterclockwise direction is not possible if the follower of the lever device reaches the top of the steep flank of the cam. This configuration therefore leads to jamming with the risk of damaging or even breaking components.

Also, like the variants of the mechanism 3 represented in FIGS. 12 and 13, the mechanism 3' includes a clutch associated with the retrograde system that enables the follower to be uncoupled from the cam. In the mechanism 3', this system further allows bidirectional rotation of the cam during the operation of adjusting the time information. This clutch has the specific feature of acting directly on the retrograde lever device L, notably through movement in rotation of the isolating device. In fact, such a configuration advantageously allows interaction of the time information correction and storage functions. Another advantage lies in the fact that it minimizes the number of components required when it is a matter of multiplying the correction mechanisms.

In the prior art solutions, it appears that immobilization of the lever determining the display of time information during any phase of storing time information immobilizes the return lever allowing disengagement of said lever. Thus, in this configuration, the stem cannot be pulled out and the correction position reached.

The embodiments of the correction mechanisms in accordance with the second aspect of the invention allow the aforementioned defects to be remedied. In fact, they can be actuated at any time, i.e. even when time information is stored.

Figure 18:
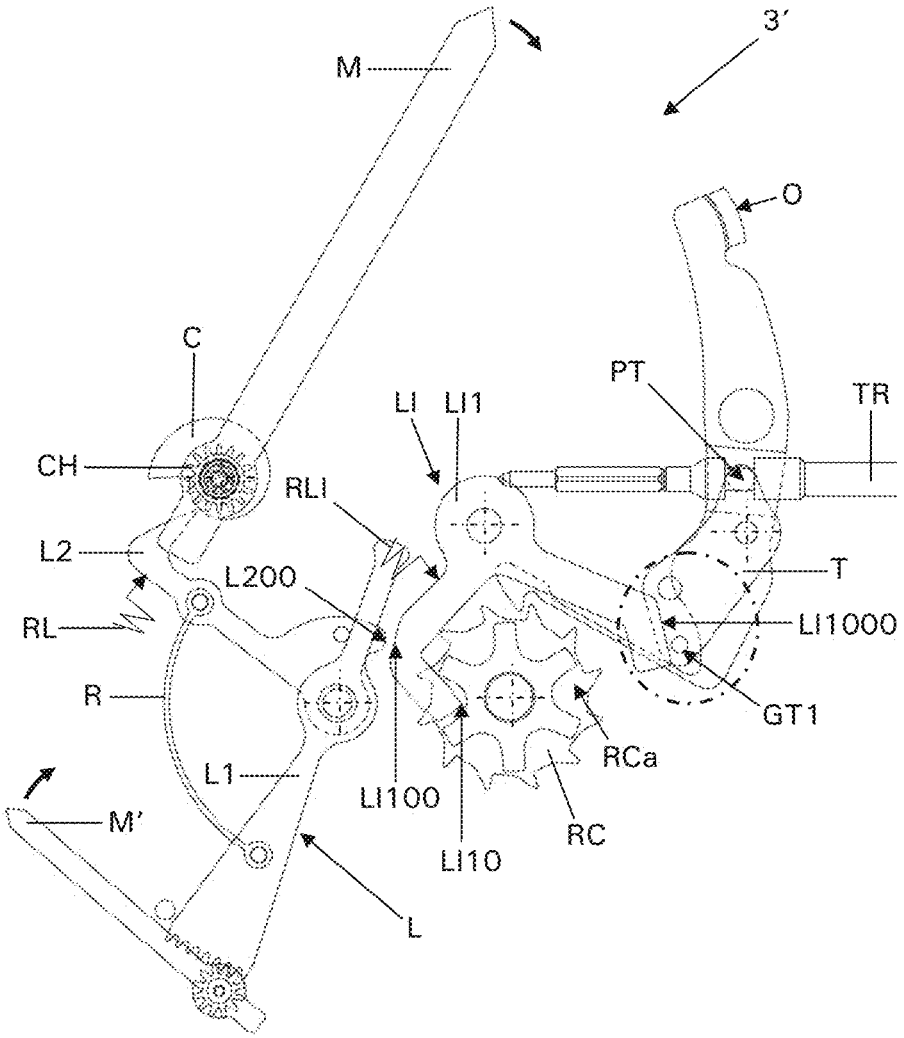
FIGS. 18 to 22 are diagrammatic views of one embodiment of a mechanism in accordance with the second aspect of the invention.

As represented in FIG. 18, the mechanism 3' for correcting a device for displaying time information includes a first member M for displaying first time information and a second member M' for displaying first stored information. The mechanism includes a device for isolating the first and second display members.

Figure 14:
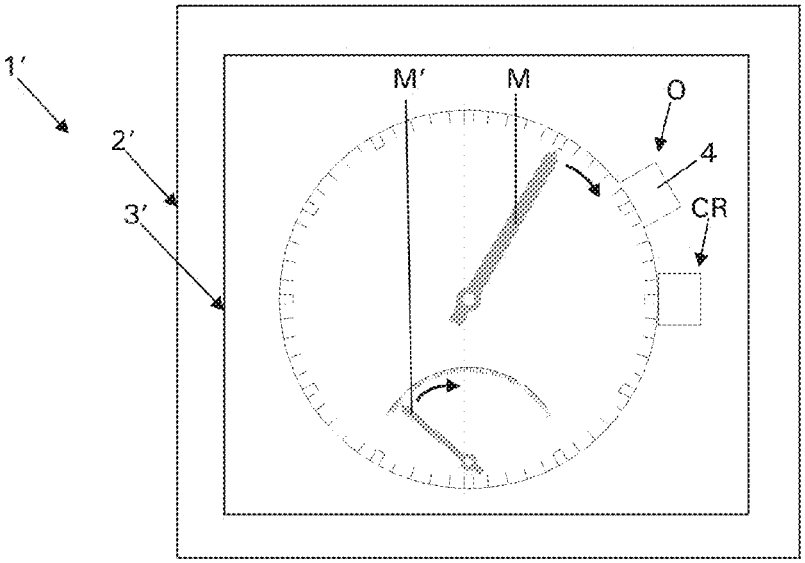
FIGS. 14 to 17 are diagrammatic views of one embodiment of a timepiece in accordance with a second aspect of the invention.
Figure 15:
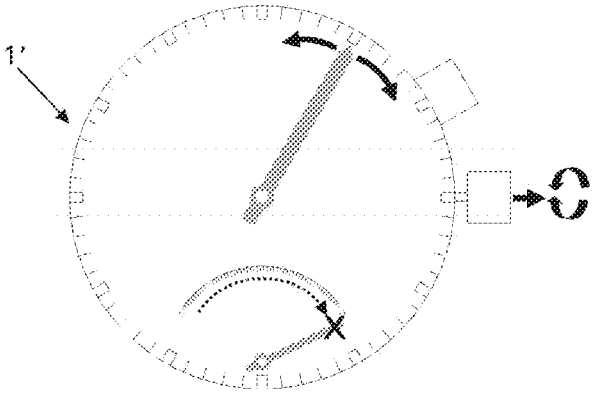

Thanks to the presence of the isolating lever, it is possible to have the mechanism function as indicated hereinafter. In normal operation, as represented in FIG. 14, the second display member M', just like the first display member M, indicates the current minute, for example. In the correction phase, as represented in FIG. 15, namely when an adjustment crown CR is pulled out, the second display member M' is positioned in a predetermined position while bidirectional rotation of the adjustment crown causes the first display member M to be driven in both directions. The predetermined position is preferably time-invariant.

Figure 16:
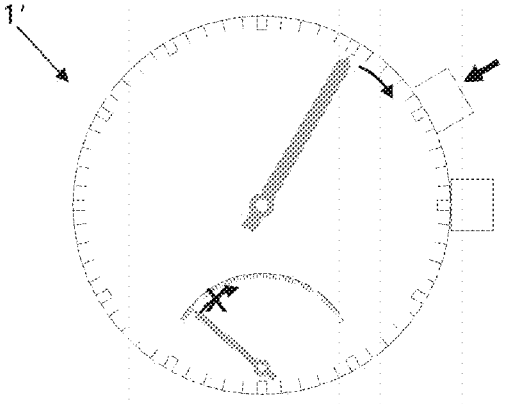
Figure 17:
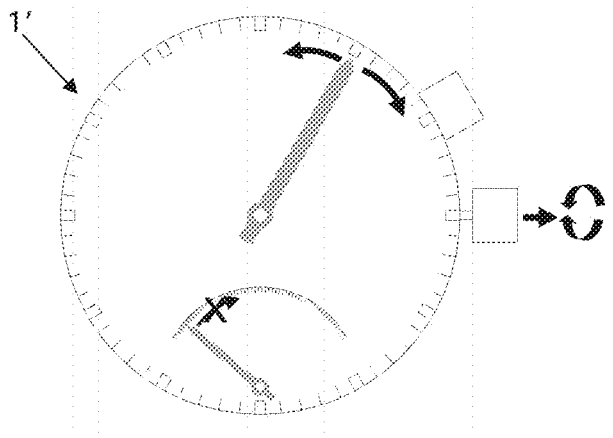

In the storage phase, as represented in FIG. 16, by virtue of the actuation of the drive member O, the second display member is stopped while the first display member continues to move. In this configuration, as represented in FIG. 17, the adjuster crown CR has no effect on the second display member M', which remains in its position as defined by the drive member O. Bidirectional rotation of the adjuster crown CR then drives the first display member M in both rotation directions.

The isolating device therefore has a first configuration in which the positions of the first and second members are linked and a second configuration in which the positions of the first and second members are independent.

As in the first embodiment, the mechanism 3' may include a snail-shaped cam C carried directly by a cannon pinion CH on which the first display member is fixed, notably countersunk. The second display member M' is moved by a retrograde system analogous to that described in the first embodiment.

The isolating device may be conformed so that it can be actuated by a pull-out piece T of the correction mechanism and by a cam RC of the storage mechanism.

In normal operation, as represented in FIG. 18, namely when the first and second display members are coupled or synchronized, the isolating device is in the first configuration. To be more specific, the isolating device is conformed or adapted to be out of reach of the retrograde lever device L. To be more specific, an end LI10 of the isolating device LI is located in a recess of the binary profile RCa of the cam RC by virtue of the effect of a spring RLI so that a flank LI100 of the isolating device LI is out of reach of a flank L200 of the follower L2.

The isolating device LI may be actuated by a correction member, notably a stem TR or a pull-out piece T, to position the follower L2 selectively in a first position defined by the first configuration of the isolating device LI and in a second position defined by the second configuration of the isolating device.

Actuation of the isolating device LI by the correction member may cause rotation of the lever device L10.

As stated above, the isolating device and the correction member may be such that actuation of the isolating device LI by the correction member causes positioning of the second display member M' in a predefined position, notably in an extreme or abutment position. This position can indicate the correction status to the user. In the storage phase, the display may also be corrected. In this case, the second member M' remains in the position that is stored. These functions are provided by a particular arrangement of the isolating device LI, the correction member T, TR, of the storage drive member RC and the immobilizer LB. In each of the two cases, the isolating device is in the second configuration. In addition to the arrangement represented in FIGS. 18 to 22, other arrangements are obviously feasible.

Furthermore, the drive member O and the isolating device LI are advantageously such that the drive member can actuate the isolating device. In particular, this actuation is effected via the storage drive member RC.

The isolating device is therefore in the first configuration, unless the drive member or the correction member is in a state conditioning the second configuration of the isolating device. The foregoing "or" is an "inclusive-or", i.e. it suffices for the drive member and/or the correction member to be in a state conditioning the second configuration of the isolating device for the isolating device to be in this second configuration. If the drive member and the correction member are each in a state conditioning the second configuration of the isolating device, the isolating device is a fortiori in this second configuration.

The pull-out piece T of the correction mechanism has an entirely conventional mode of operation. It is interengaged with the stem TR via a pull-out piece stud PT so that it is driven in rotation when the stem is actuated in translation. The positions of the stem:

1.—neutral position,

2.—adjustment position, are also defined conventionally, by the notching effect of a jumper (not represented in the figures) provided to cooperate with the pull-out piece.

Figure 19:
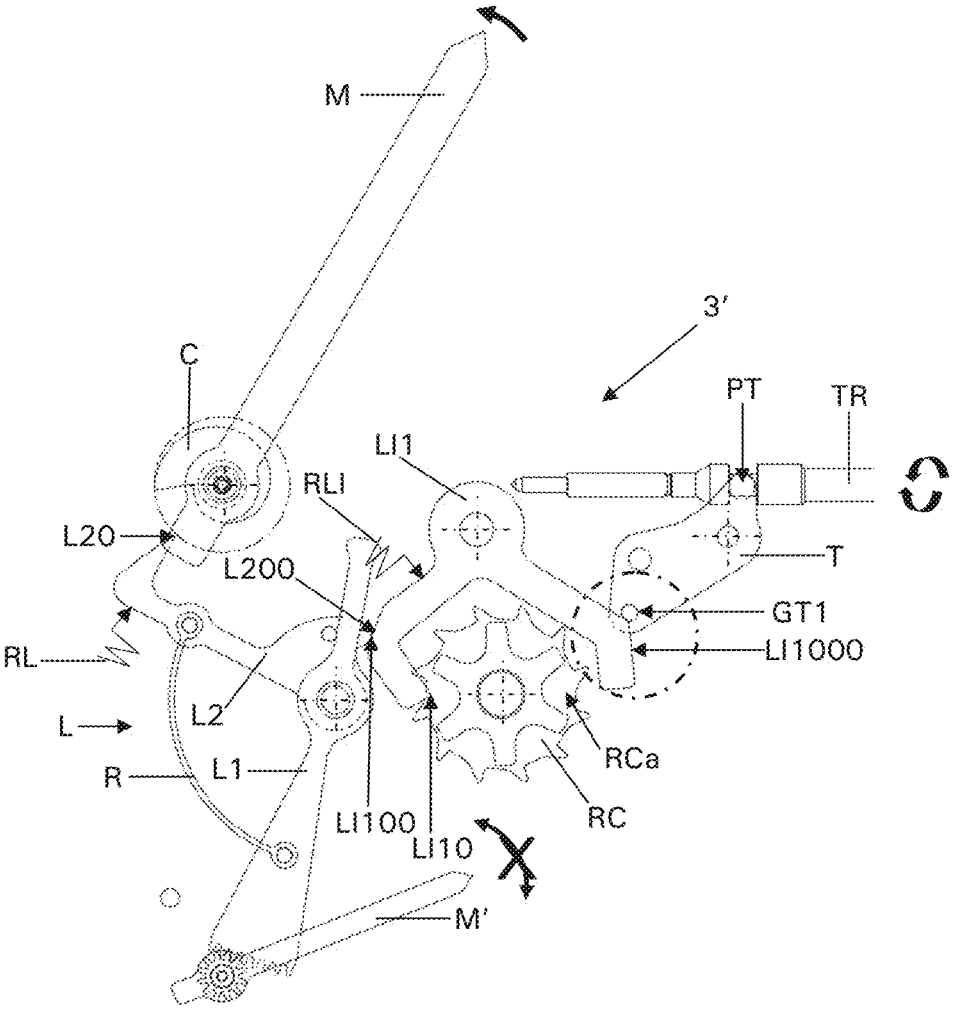

In the FIG. 18 configuration, a flank LI1000 of the isolating device faces a pin GT1 of the pull-out piece T. Traction on the setting stem TR therefore causes pivoting of the isolating device via the pin GT1, which comes to bear on the flank LI1000 of the isolating device. In the adjustment phase, the flank LI100 of the isolating device LI therefore actuates the flank L200 of the lever device L, which positions the lever device L against the action of the return spring RL in a particular angular position to remove the follower L20 from the path of the cam C. Bidirectional rotation of the cam C is therefore allowed. The kinematic system CM for correcting the display indicated by the first display member M can therefore be driven in both rotation directions, as represented in FIG. 19.

Figure 20:
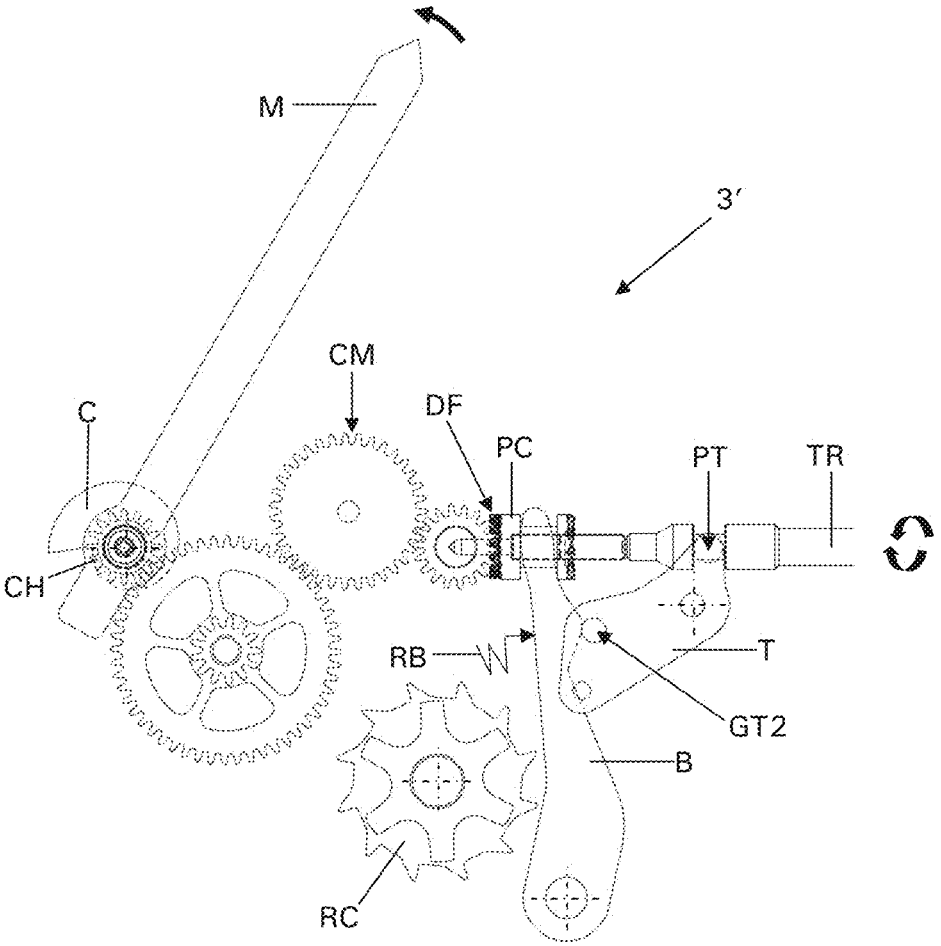

The kinematic system CM can be activated by the effect of a pin GT2 of the pull-out piece T. In the adjustment position, this system positions a lever B against a spring RB so as to engage the kinematic system CM by way of the front teeth DF of a winding sliding pinion PC, as represented in FIG. 20.

Figure 21:
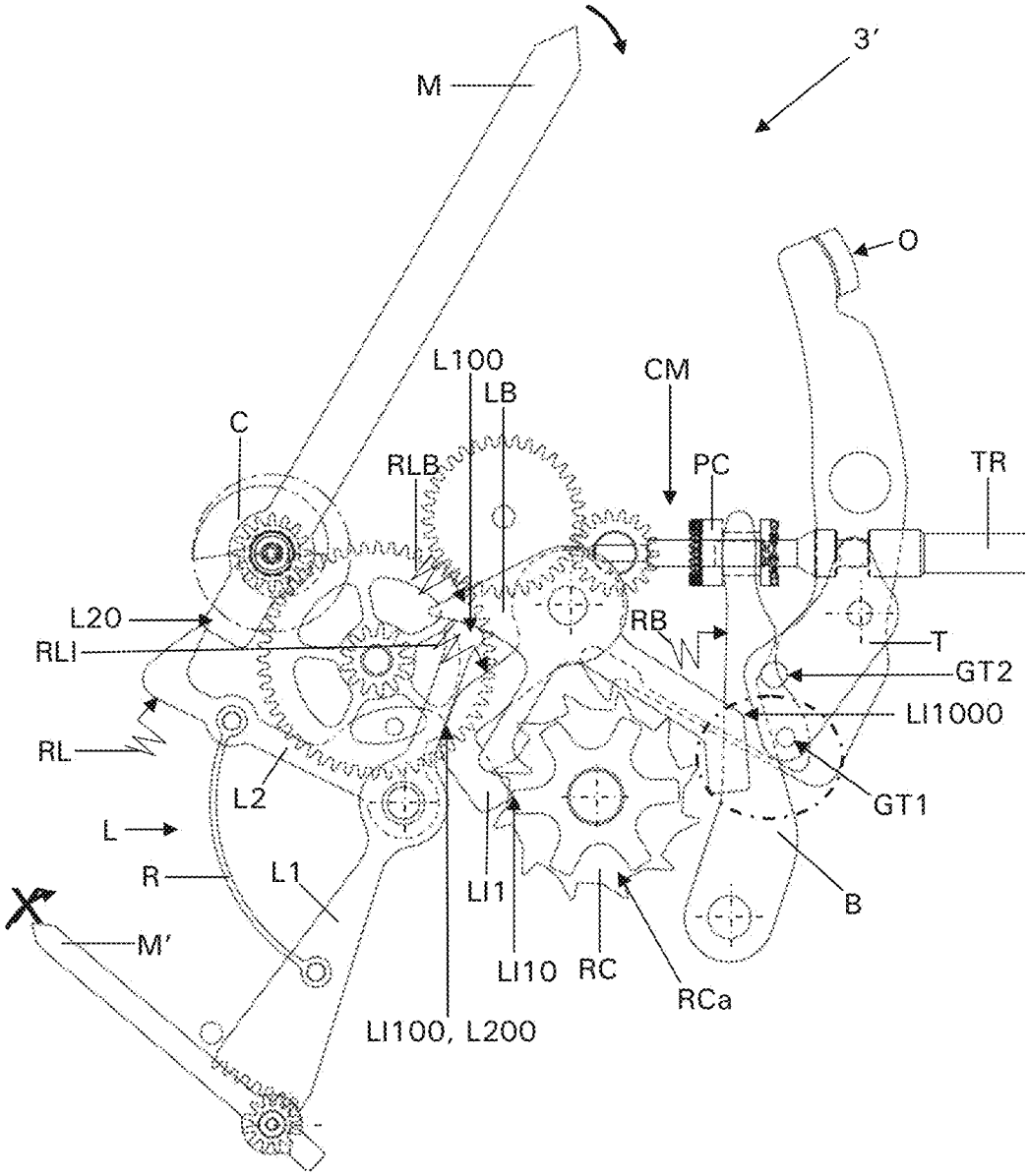
Figure 22:
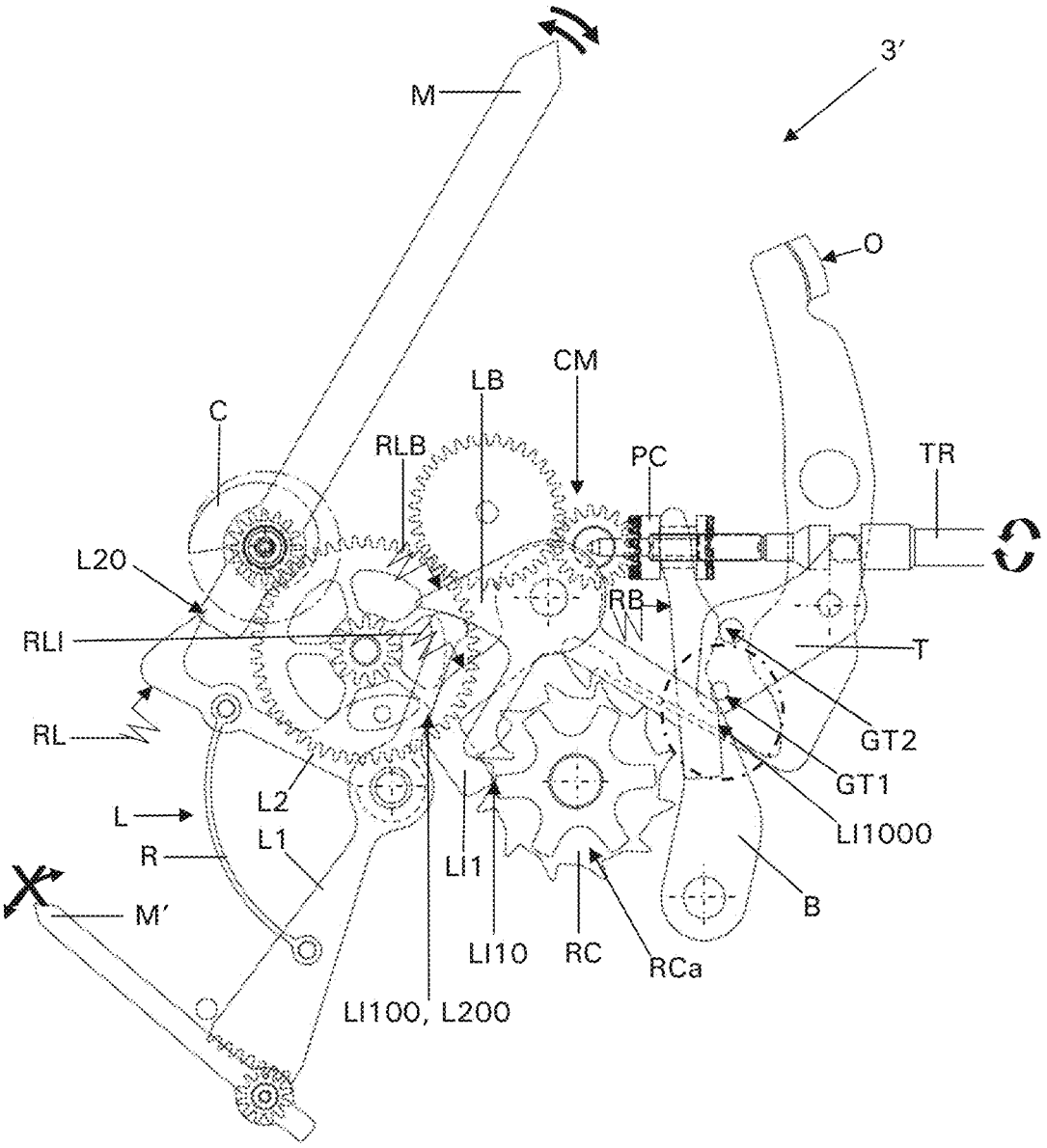

The isolating device is adapted, during the storage phase, as represented in FIG. 21, namely when the second display member M' is immobilized by the effect of an immobilizing lever or immobilizer LB, the isolating device LI is adopted to remove the follower L20 from the path of the cam C by virtue of the effect of the drive cam RC. To be more specific, the end LI10 of the isolating device LI bears against one of the columns of the cam RC so that the flank LI100 lifts the flank L200 of the lever L2 against the action of the springs R and RL. In this configuration, the pin GT1 of the pull-out piece T is out of reach of the flank LI1000 of the isolating device LI. Traction on the setting stem TR therefore has no effect on the isolating device LI which has been positioned beforehand so that the follower L20 is removed from the path of the cam C. Bidirectional rotation of the cam C is therefore allowed. The kinematic system CM provided for correcting the display indicated by the first display member M can therefore be driven in both rotation directions, as represented in FIG. 22.

Accordingly, the follower L2 is preferably adapted, in the first position of the isolating device LI, to bear against the cam C coupled to the first display member M by virtue of the effect of a second elastic member. The follower L2 can be adapted, in a second position of the isolating device LI, to be uncoupled from the cam C, i.e. held at a distance from the cam.

The isolating device LI may include the isolating lever LI1 capable of acting on or adapted to act on the pivoted lever device L including the lever L1, the follower L2 and the first elastic member R urging the lever L1 and the follower L2 into a particular relative position. The lever L1 is kinematically coupled to the second display member M'.

The isolating device, the correction member and the follower are adapted so that the follower is positioned in the second position by the correction member TR, T when the immobilizer LB is in a first position releasing the lever L1.

The immobilizer LB can cooperate with the storage drive member RC to position the immobilizer selectively in a first position releasing the lever L1 or in a second position immobilizing the lever L1.

The isolating device LI may be adapted to act on an end L200 of the follower L2 and/or to act on the follower obstacle fashion.

In other words, in accordance with the second aspect of the invention, the isolating device preferably includes:

- a first member adapted to couple it kinematically to the correction member, notably by cooperation through contact,
- a second member adapted to connect it kinematically to the storage drive member, notably by cooperation through contact,
- a third member adapted to couple it kinematically to the follower, notably by cooperation through contact.

The configuration, notably the position, of the correction member and the configuration, notably the position, of the storage drive member determine the configuration, notably the position, of the isolating device. The configuration, notably the position, of the isolating device and the configuration, notably the position, of the storage drive member determine the configuration, notably the position, of the follower.

Of course, a plurality of correction devices may be associated to correct more than one item of time information, notably items of information that are kinematically linked to one another, for example the hours and minutes indications. These devices could advantageously be driven by a single pull-out piece T and a single drive cam RC so as to drive synchronously isolating levers specific to each of the members for displaying stored time information. The isolating levers LI and the pull-out piece T could preferably form a single kinematic system.

In the various embodiments, the immobilizer could be actuated directly by a drive member such as a push-piece, without employing a column wheel. In this case, the stored information may be displayed only when the user acts on the drive member.

In the various embodiments, the immobilizer LB may be adapted to immobilize the lever L1 whatever the position of the lever L1 in the "storage" phase. In other words, in the "storage" phase, the immobilizer LB may be adapted so that it can stop the display member S' whatever the position of the display member S'.

In the various embodiments, the lever device L may be manufactured in one piece or of unitary construction, in which case the first elastic member is an elastically deformable part, notably an elastically deformable part separating the lever L1 and the follower L2.

In the various embodiments, "storage of time information" preferably means an action of memorizing time information. This action of placing in memory is preferably triggered by an action of the user. This memorizing action preferably concerns memorizing the current or instantaneous time information at the time of the action by the user. New time information can therefore be stored on each specific action of the user. The display of this stored time information may be maintained. The storage of time information may consist in fixing the current or instantaneous time information. Other members may continue to display the current time information if some are fixed or immobilized to indicate the stored time information.

In the various embodiments, the first elastic member and the second elastic member are separate.

In the various embodiments, the follower L2 may be articulated or pivoted on the lever L1.

Positioning of display members in one or more positions at random or defined once and for all, i.e. in one or more positions not definable or modifiable by the user, as may be encountered in on-demand display mechanisms, does not constitute storage in the sense of the invention.

In the absence of any technical or logical incompatibility, the first and second aspects of the invention may obviously be combined.

The invention claimed is:

1. A mechanism for correcting a display device for displaying time information, the display device comprising a first display member for displaying current time information, and a second display member for displaying stored time information, the mechanism comprising:

- an isolating device for isolating the first and second display members,
- a correction element, wherein the correction element is adapted to correct a time information, and
- a drive member,
- wherein each of the correction element and the drive member actuates the isolating device, so as to isolate the first and second display members from each other.

2. The mechanism as claimed in claim 1, wherein each of the correction element and the drive member actuates the isolating member for selectively positioning the isolating device in a first configuration in which positions of the first and second display members are linked, and in a second configuration in which the positions of the first and second display members are independent.

3. The mechanism as claimed in claim 1, in which the isolating device and the correction element are arranged in such a way that actuation of the isolating device by the correction element causes the second display member to be positioned in a predefined position.

4. The mechanism as claimed in claim 3, wherein the predefined position is an extreme or abutment position.

5. The mechanism as claimed in claim 1, in which the isolating device is actuated by the correction element, for selectively positioning the isolating device in the first configuration of the isolating device and in the second configuration of the isolating device, and in which the isolating device is in the first configuration unless at least one of the drive member and the correction element is in a state conditioning the second configuration of the isolating device.

6. The mechanism as claimed in claim 1, in which the isolating device comprises an isolating lever capable of acting on a pivoted lever device, and in which the lever device comprises a lever, a follower and a first elastic member returning the lever and the follower to a particular relative position, the lever being kinematically linked to the second display member.

7. The mechanism as claimed in claim 6, in which the isolating device has a first configuration in which positions of the first and second display members are linked and a second configuration in which the positions of the first and second display members are independent, in which, when the isolating device is in the first configuration, the follower is arranged in such a way as to press against a cam connected to the first display member under the effect of a second elastic member, and in which, when the isolating device is in the second configuration, the follower is arranged in such a way as to be disconnected from the cam or kept away from the cam.

8. The mechanism as claimed in claim 7, in which the isolating device is actuated by a correction element, to position the follower selectively in a first position defined by the first configuration of the isolating device and in a second position defined by the second configuration of the isolating device.

9. The mechanism as claimed in claim 6, in which the isolating device is actuated by a correction element, to position the follower selectively in a first position defined by the first configuration of the isolating device and in a second position defined by the second configuration of the isolating device.

10. The mechanism as claimed in claim 9, in which actuation of the isolating device by the correction element causes rotation of the lever.

11. The mechanism as claimed in claim 6, in which the mechanism comprises an immobilizer for immobilizing the lever and collaborating with a storage drive member for selectively positioning the immobilizer in a first position releasing the lever or in a second position immobilizing the lever.

12. The mechanism as claimed in claim 6, in which the isolating device, the correction element and the follower are at least one of (i) arranged in such a way that the follower is positioned in the second position by the correction element when an immobilizer is in a first position releasing the lever, and (ii) arranged in such a way that the follower is positioned in the second position by the isolating device when an immobilizer is in a second position immobilizing the lever.

13. The mechanism as claimed in claim 6, in which the isolating device is at least one of (i) designed to act on an end of the follower and (ii) designed to act through an obstacle on the follower.

14. A timepiece movement comprising a mechanism as claimed in claim 1.

15. A timepiece comprising a movement as claimed in claim 14.

16. A timepiece comprising a mechanism as claimed in claim 1.

17. The mechanism as claimed in claim 1, wherein the second display member of the display device is a retrograde display member.

18. The mechanism as claimed in claim 1, wherein the correction element is a stem.

19. The mechanism as claimed in claim 1, wherein the correction element is adapted to correct the time information of the first display member.

20. The mechanism as claimed in claim 19, wherein the correction element is adapted to correct the time information of the first display member in a forward direction and a reverse direction.

21. The mechanism as claimed in claim 1, wherein the mechanism comprises:

a first kinematic chain for actuation of the first display member, a second kinematic chain for actuation of the second display member, and a clutch connecting the second kinematic chain to the first kinematic chain, and wherein the isolating device actuates the clutch between (i) a first configuration in which the first and second kinematic chains are coupled, and (ii) a second configuration in which the first and second kinematic chains are uncoupled.

22. A mechanism for correcting a display device for displaying time information, the display device comprising a first display member for displaying current time information, and a second display member for displaying stored time information, the mechanism comprising:

an isolating device for isolating the first and second display members, wherein the isolating device comprises an isolating lever capable of acting on a pivoted lever device, wherein the lever device comprises a lever, a follower and a first elastic member returning the lever and the follower to a particular relative position, the lever being kinematically linked to the second display member, wherein the isolating device acts on the follower, for selectively positioning the first and second display members in a first configuration and in a second configuration, wherein in the first configuration, the isolating device releases the follower, so that the follower is pressed against a cam connected to the first display member under the effect of a second elastic member, and wherein in the second configuration, the isolating device acts on the follower, so that the follower is disconnected from the cam or kept away from the cam.

* * * * *